106-97 AU 113 EX
5/20/80 XR 4,203,456

United States Patent [19]

Miller

[11] 4,203,456

[45] May 20, 1980

[54] SMOKING PIPE

[76] Inventor: Richard T. Miller, Cedar La., Ossining, N.Y. 10562

[21] Appl. No.: 828,222

[22] Filed: Aug. 26, 1977

[51] Int. Cl.[2] ..... A24F 1/32
[52] U.S. Cl. ..... 131/230; 106/97
[58] Field of Search ..... 131/230, 226, 171; 106/97

[56] References Cited

U.S. PATENT DOCUMENTS

| | | | |
|---|---|---|---|
| 191,385 | 5/1977 | Thurston | 131/230 |
| 974,051 | 10/1910 | Genthner | 131/230 |
| 1,368,371 | 2/1921 | Taylor | 131/230 UX |
| 2,352,201 | 6/1944 | Jacob | 131/230 |
| 3,091,246 | 5/1963 | Mahieux | 131/230 UX |
| 4,042,406 | 8/1977 | Gray | 106/97 |

*Primary Examiner*—Stephen C. Pellegrino

[57] ABSTRACT

A smoking pipe which is porous, lightweight, chemically neutral so as not to adversely affect taste, thermally insulating, easy to make by reasonably cheap manufacturing methods, and inexpensive. The pipe is characterized by a tobacco-holding bowl which is comprised of a lightweight, porous concrete comprised of Portland cement and the following materials which may be individually present or in any combination with one another: perlite, pumice, vermiculite, molecular sieve materials, and other mixed oxides of calcium, silicon and aluminum, or mixtures of these having the desired properties of porosity, weight and stability at high temperatures. The porosity of the hardened Portland cement paste, purposely mixed with an excess of water to produce high porosity, is matched to that of the aggregate material (perlite, pumice, vermiculite, etc.). A surrounding jacket of a plastic material, such as high density polyethylene or polyvinyl chloride, can be used to strengthen the pipe bowl against fracturing, and for decorative purposes.

15 Claims, 1 Drawing Figure

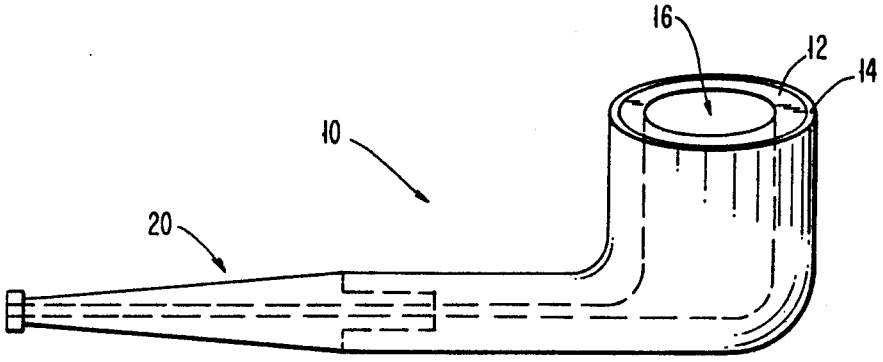
16
12
14
10
20

SMOKING PIPE

BACKGROUND OF THE INVENTION

1. Field of the Invention

This invention relates to improved smoking pipes, and more particularly to an improved smoking pipe having a bowl comprised of a lightweight Portland cement concrete, including Portland cement paste of high porosity (high water to cement ratio), and lightweight, porous aggregate materials.

2. Description of the Prior Art

The use of pipes for smoking dates back hundreds of years, and the qualities of good pipes are well known to all smokers. Perhaps the most important of these qualities is taste. A pipe must be sufficiently neutral so that the smoker will be able to taste the tobacco which he has chosen. This quality of proper taste is perhaps the most difficult quality to obtain when an inexpensive pipe is chosen.

Other qualities which good pipes must provide include a cool and dry smoke having an agreeable and mild taste and one which is absolutely free from biting and disagreeable effects. Also, the pipe bowl should not get excessively hot to the touch and the pipe itself should be light in weight, porous, and capable of absorbing the moisture and tars produced by the burning tobacco thereby preventing the formation of a wet soggy mass of tobacco in the bowl which results in difficult flammability of the tobacco and unpleasant taste.

Another quality that good pipes have is the quality of not requiring extensive "breaking in", that is, pre-smoking, before normal use. However, many pipes which taste good and are cool to the touch are expensive and difficult to make.

High quality pipes can be provided from bowls made of briar or meerschaum, as is known in the art. Briar is a root of a particular bush or tree, having a woody structure but being relatively hard, impervious, and resistant to burning. Meerschaum is a mineral substance, seprilite, which is imported from Asia Minor. This mineral is a fine, porous, clay-like material which is soft and light in weight, and does not impart a foreign taste or odor to burning tobacco.

Although high quality briar and meerschaum are excellent materials for smoking pipes, they are becoming scarce and increasingly expensive. Consequently, these materials have sometimes been used only as liners in pipes in order to reduce cost.

The prior art includes many attempts to provide good pipe substitutes for briar and meerschaum. However, these alternate materials have not found widespread acceptance, primarily due to taste considerations or considerations relative to the other qualities mentioned earlier. One alternative pipe bowl material that has been used is a hollowed cut corncob. Although this is cheap, it has many disadvantages, such as the disadvantage of contributing undesirable and disagreeable taste to the smoke. Also, corncob pipes develop a disagreeable taste after relatively short usage.

Other alternative pipe materials include cherry wood and hickory wood. However, pipes made from these materials have disagreeable tastes and are not popular for this reason. Still further alternative pipe materials include those having a thick plastic outer layer and an extremely thin layer of pyrolytic graphite which serves primarily as thermal insulation. Such pipes are very heavy, non-absorbent of moisture, and exhibit very poor taste.

U.S. Pat. No. 1,683,959 describes a pipe having an outer shell of wood or similar material and an inner liner of burnt clay and a cementitious mixture (a general term describing a binder material). This pipe was made to simulate clay pipes. It is generally heavy and does not last long. This pipe is made of fragile material and, most importantly, lends a harsh taste to the tobacco and smokes very hot because it is a good conductor of heat. Thus, it is basically a ceramic pipe of heavy weight, high heat conductivity, and poor taste. As will be more apparent, the pipes of the present invention are distinguished from this type of pipe in that they are comprised of a composite aggregate which is extremely porous and lightweight, and which does not adversely influence taste.

U.S. Pat. No. 204,774 describes pipes having carved pumice stone interiors with an outer coating which is applied in a plastic condition and then hardens. Examples of this outer coating include meerschaum chips, compositions of magnesia, plaster of paris, chalk, or other substances which can be applied in a plastic condition and then hardened. The disadvantage of these pipes is that any of the materials suggested lend terrible tastes to the smoking tobacco. Also, such materials as magnesia, plaster of paris, and chalk are brittle and disintegrate when subjected to heat or dropped.

U.S. Pat. No. 191,385 also describes a pumice-stone pipe which uses pulverized pumice stone mixed with some cementitious material. However, the patent points out that the porosity of the natural pumice would be destroyed if mixed with some cementitious material and therefore teaches away from this combination.

U.S. Pat. No. 1,368,371 describes pipes having an outer wood shell and an inner layer of Portland cement or plaster of paris, or a mixture of these. The disadvantages here are that both plaster of paris and Portland cement paste provide heavy pipes of poor porosity and low heat insulation. The use of a porous, lightweight aggregate with cement is essential, and is only taught in the present invention.

Other patents generally describing pipes which are alternatives to briar and meerschaum pipes include U.S. Pat. No. 379,585 and U.S. Pat. No. 3,695,276. The first of these describes a pipe having an outer bowl of a material such as wood, and an inner bowl of an absorbent material such as paper pulp. This pipe tends to get very hot and the inner lining does not last long. The second patent describes a pipe which is made of a chemical composition including poly (arylene sulfide). This material can be mixed with asbestos, paperbestos, or glass. The main disadvantage of this pipe is its poor taste when smoked.

U.S. Pat. No. 2,485,222 and 3,422,821 describe pipes having plastic layers on the outside of the bowl and meerschaum inner linings. As mentioned, these are attempts to obtain the good qualities of meerschaum but at lower cost. The resulting pipes are no better than commonly used briar pipes. U.S. Pat. No. 1,727,763 describes a smoking pipe having an inner bowl comprised of briar, etc. and an outer bowl of a resin which rigidly contacts the inner bowl. Again, this pipe still requires the use of more expensive materials and does not provide any significant advantages over conventional briar pipes.

In contrast with the prior art pipes mentioned, the present invention is a high quality pipe that is inexpensive and easy to fabricate. It is comprised of inert materials which will not adversely affect the tobacco taste and which will introduce no chemical impurities into the smoke. Also, this pipe has high porosity and is therefore very absorbent. Because of this, complicated structures for trapping moisture do not have to be utilized. In further contrast with the prior art, materials having very high porosity are held together by a cement which has approximately the same porosity and chemical composition so that the diffusion properties of the pipe are maintained. The porosity of the cement can be varied on a molecular scale while still maintaining the durability and lightness of the pipe.

Accordingly, it is a primary object of this invention to provide a pipe which has the qualities of a good, expensive pipe, but which is fabricated from readily available, inexpensive materials.

It is another object of this invention to provide inexpensive substitutes for briar and meerschaum pipes without sacrificing smoking quality.

It is a further object of this invention to provide a smoking pipe of unique composition which does not require extensive "breaking-in" (pre-smoking) before normal use, and which is inexpensive and yet of high quality.

It is yet another object of this invention to provide a pipe which can be cast in any shape or decorative form, at low cost, without the expensive machining or carving necessary with such materials as briar or meerschaum.

Another object of this invention is to provide a pipe material which can successfully be sheathed with a strong plastic material, applied at relatively high temperature (425° F.), for strength and durability against the cracking, common in other pipe materials, caused by the buildup of carbon in the pipe bowl after extended smoking of the pipe.

SUMMARY OF THE INVENTION

This invention describes smoking pipes and methods for making them which provide low cost, high quality alternatives to quality pipe materials presently known. These alternatives satisfy all of the qualities previously mentioned and in particular have good taste, are of light weight and high porosity, and have good insulation properties.

These pipes are comprised of a porous aggregate including a relatively watery mixture of Portland cement (as compared with the water-cement ratio used to produce structural concrete) together with a porous aggregate material such as perlite, pumice, molecular sieve materials, vermiculite, and other mixed oxides of, primarily, calcium, silicon and aluminum, with smaller amounts of iron and other elements, and mixtures of these materials. The Portland cement mixture is chosen to have a porosity similar to that of the aggregate. In fact, the pipe material comprising the Portland cement and the aggregate is sufficiently lightweight and porous that it will float on water, in contrast with ceramic-binder pipes, which will sink when placed in water. In the present invention, the porous aggregate particles are joined by an equally porous cement binder in order to obtain a pipe bowl having a uniformly high porosity.

If desired, a plastic type jacket or layer can be provided around the porous tobacco bowl to provide increased strength and better appearance. Conventional polyvinylchloride or high density polyethylene materials can be used for the outer layer, or jacket.

When making the pipe, the plastic jacket can be formed first by a molding process and then can be used as a mold for holding the concrete mixture as it sets. Additionally, the reverse technique can be used in which the cement plus aggregate can be cast in a mold and then dipped into a suitable plastic and cured to provide the outer, protective layer. In this case, the contraction of the cooling plastic tightly grips or "prestresses" the concrete bowl to provide a mechanically durable pipe.

The materials used for the inner tobacco bowl are chemically inert and do not impart a foreign taste to the tobacco as it is burning. Therefore, the smoker is able to enjoy the full taste of the tobacco he has chosen, in a lightweight, porous pipe which can be produced by simple, inexpensive methods, and which does not require expensive or scarce materials.

These and other objects, features and advantages will be apparent from the following more particular description of the preferred embodiments.

BRIEF DESCRIPTION OF THE DRAWING

FIG. 1 shows a pipe comprising an improved bowl in accordance with the principles of the present invention.

Detailed Description of the Preferred Embodiments

FIG. 1 shows a pipe 10 having a bowl comprising an inner layer 12 and an outer layer 14. A cavity 16 is provided for the tobacco to be smoked. The rest of the pipe is comprised of a stem portion 18, and bit, 20. These portions of the pipe are well known in the art, and the present invention is primarily concerned with the materials used to provide the bowl and stem portions of the pipe.

The bowl is formed by layer 12 which is comprised of a porous aggregate including a watery mixture of Portland cement together with porous aggregate material such as perlite, pumice, molecular sieve materials, vermiculite, mixed oxides of calcium, silicon and aluminum, as well as mixtures of these various materials. The Portland cement paste has a porosity similar to that of the porous aggregate. This provides a very lightweight pipe having high porosity. The porous aggregate materials are not isolated from one another by the Portland cement in this pipe, since the mixture of Portland cement paste is chosen to be watery in order to have high porosity. Thus, the mixture of Portland cement and the porous aggregate materials has a porosity essentially the same as that of the porous aggregate. If desired, an outer layer or jacket 14 can be provided around the bowl and stem material, 12 and 18, to provide increased strength and better appearance of the pipe. Layer 14 is typically comprised of conventional polyethylene, preferably high density, or vinyl-type materials.

As will be described in more detail later, the material 12 is generally comprised of a watery mixture of Portland cement and porous aggregate where the ratio of aggregate/cement is generally in the range 3/1–8/1 by volume, inclusive. White cement is typically preferred for appearance purposes. The richer mixture (3/1) of aggregate/cement is stronger but heavier than the leaner mixture (8/1). However, since the porous aggregate is so light, the overall weight of the pipe is still very light.

Concrete ordinarily used for structural materials consists of a mixture of Portland cement, water and aggregates such as natural sand, gravel or crushed stone. The quality of the concrete depends largely upon the proportions of the ingredients, especially the proportion of water to cement, but the weight of such concretes depends primarily on the aggregate used and generally averages about 150 pounds per cubic foot. Concrete of lighter weight can be produced by using an admixture which causes swelling or foaming of the mixture or by the use of lightweight aggregates. Such concretes generally weigh from 40 to 80 pounds per cubic foot, and usually about 50 pounds per cubic foot. However, foamed concrete often does not have sufficient porosity for use in this invention. The most widely used foaming agents, called "air-entraining" agents, in fact interrupt the pore structure of cement paste. This is the basis of their use to reduce frost damage to concrete pavement. In the experiments leading to this invention, air-entraining agents were found to be extremely harmful to the smoking quality of the pipes. For the practice of the present invention, watery mixtures of cement and aggregate provide good porosity, the resulting mixture having interconnected porosity throughout its thickness. This is one of the key reasons for the improved smoking quality of the present pipe.

Lightweight concrete aggregates which have been employed for the manufacture of lightweight concrete include such materials as expanded shale and expanded clay (often used for structural purposes), pumice, pumicite (finely divided pumice), perlite, expanded vermiculite, diatomaceous earth and the like. Of these, expanded shale or expanded clay provide a relatively heavy finished concrete averaging about 100 pounds per cubic foot. Althoug this is considerably lighter than ordinary concrete prepared with sand and gravel, which weighs about 150 pounds per cubic foot, it is preferred to employ an aggregate which gives an even lighter concrete product for use in smoking pipes. The materials which are preferred for use are pumice, pumicite, perlite, molecular sieve materials, and mixed oxides of calcium, silicon and aluminum, all of which provide useful finished concrete masses of from about 50 to about 75 pounds per cubic foot, or at most one half the weight of ordinary concrete. Of these, it is especially preferred to use perlite or pumice, or a mixture of these with vermiculite, which can be employed to give a lightweight concrete weighing 60 to 75 pounds or less per cubic foot having a reasonable compressive strength, exceeding 750 psi and preferably greater than 1000 psi (ASTM Test C39—49). Also, mixtures of these various aggregates can be used where the ratio of total aggregate/cement is about 3/1 to about 8/1, inclusive.

The Portland cement which is employed as an essential ingredient of the concrete mix from which the smoking pipes of this invention are fabricated is the ordinary Portland cement which is a well known article of commerce. Such cements are hydraulic cements manufactured from calcerous materials such as limestone or marl and clayey materials such as clay or shale. The raw materials are usually crushed, pulverized and mixed, then fed to rotary kilns wherein they are calcined at temperatures of about 2700° F. The cooled mass from the kiln is pulverized, mixed with a small amount of gypsum and ground to an extremely fine powder. Such cements consist chemically of a mixture of calcium silicates, calcium aluminates and calcium alumino-ferrite. Portland cement is ordinarily manufactured to meet the "Standard Specifications for Portland Cement" (ASTM C150–41), which provides for five types of Portland cement which vary slightly in chemical composition, each type being particularly suitable for certain specified structural uses. For the present purposes, it is preferred to employ Portland cement of Type I, which is normal Portland cement usually used for pavement and sidewalk construction, reinforced concrete buildings, sewers, culverts, and the like, although Types II to V are equally effective for producing porous, lightweight concrete suitable for manufacture of smoking pipes in accordance with this invention. Portland cements are generally available either as "white" or "gray", depending upon the particular chemical composition thereof, and either color type is equally suitable for the purpose described herein.

When Portland cement is mixed with water, a paste is formed which first sets, that is, becomes firm and then hardens for an indefinite period. The setting and hardening are brought about by chemical reactions between the cement and water and this action is generally referred to as hydration. Cement mixtures essentially reach their optimum properties after curing for at least about seven days, although continued curing results in gradually improved physical properties such as compressive strength for many years. This curing process can, of course, be speeded up by methods known in the art, for example by curing at higher temperatures or by adding accelerators such as calcium chloride.

In the preparation of concrete mixes suitable for the fabrication of the smoking pipe of this invention, it is preferred to employ a relatively wet mixture of Portland cement and water to produce a highly porous cement matrix. The amount of each of these ingredients is not critical, and can be varied within broad limits suitable for the formation of porous concrete which is not too weak for the normal use of a smoking pipe. Normal concrete is usually prepared by admixing Portland cement and water in a ratio from about 1 part by volume cement to 0.8–1.2 parts by volume water, and it has been found that such ratios of ingredients are likewise suitable for the preparation of pipe-forming mixtures. However, it is preferred to use from about 1.0 to 1.4 parts or more water per part (by volume) of cement.

As previously indicated, the aggregates which are used are lightweight commercially available materials including pumice, pumicite, perlite, vermiculite, molecular sieve materials, mixed oxides of calcium, silicon and aluminum, and mixtures of these. Perlite, pumice, and vermiculite are preferred since they are cheap, readily available, extremely light and porous and give a pipe material which provides a remarkably cool and dry smoke and imparts no foreign taste to the smoke. The amount of aggregate employed should be as large as possible, consistent with obtaining a concrete of sufficient strength to resist breakage in order to obtain as lightweight and porous a pipe as possible. Similar considerations apply to the other lightweight aggregates which have been tested.

The lightweight aggregates employed in this invention are generally lightweight materials having a preferred bulk density between about 15 and about 50 pounds per cubic foot. Pumice, for example, has a bulk density of 40–50 pounds per cubic foot, whereas lightweight aggregates such as perlite usually have densities between about 10 and 25 pounds per cubic foot. The lightweight aggregate employed should be well graded in size ranging downward, for example, from particles of a size that pass a No. 4 sieve, to particles as fine as 50 mesh. Because these lightweight aggregates tend to absorb water, they are preferably prewetted with water prior to formulation into lightweight concrete.

Fabrication

In the preparation of the novel smoking pipes of this invention, prior art techniques for molding or forming the concrete mix can be employed and such techniques form no part of the present invention. For example, the smoking pipes of this invention can be prepared by casting the lightweight concrete in the form of a pipe bowl with or without integral shank by means of male and female mold parts. Pipe bowls of solid construction can be formed and drilled out to produce a hollow bowl and shank suitable for insertion of a bit. In the casting operation, vibration or agitation is effective in compacting the concrete mixture and removing entrapped air bubbles therefrom before the concrete sets. By use of smooth mold liners, for example of such materials as plastic, glass, metal or the like, the lightweight concrete pipes can be produced with smooth, finished exterior surfaces, having a pleasing appearance and of extremely hard finish thus obviating the necessity for polishing or other finishing operations. It will be clear to those skilled in the art that pipe bowls of various shapes can readily be formed by use of appropriately shaped molds, and that various pigments can be incorporated in the concrete mix to provide pipes of any desired color.

As mentioned, polyethylene or vinyl coatings can be used on the exterior of the pipe to improve its appearance and to increase its resistance to breaking. A high density polyethylene is generally preferred because of its strength and light weight.

To apply the coating, a cement pipe can be coated with powdered polyethylene. Prior to applying the powder, the pipe is generally heated to 400°-500° F. so that the powder will adhere to the surface of the cement pipe. After the powder is applied, the pipe is then heated to about 400°-425° F. to make the polyethylene powder fuse into a smooth coating. Several repititions may be necessary to form the desired coating thickness.

To produce a vinyl jacket, the pipe is heated to about 450° F., dipped in a liquid vinyl plastisol, and cured at about 400° F. for 20 minutes to 30 minutes.

In order to obtain a good cement surface for coating with polyethylene or vinyl, and to obtain a good appearance, it is preferable to have smooth cement surfaces, both inside and outside the pipe bowl. When the cement is cast, it is heavier than water and therefore sinks. Generally, the pipe shank is cast first, then the bowl portion. When the shank is cast, it is allowed to harden, and then is etched with hydrochloric acid and coated with fresh cement paste. After this, the bowl is cast. In this manner, the bowl surface, etc. is smoother and easier to coat. The bowl portion is then drilled to form a cavity therein which is mechanically smoothed. It can also be coated with a cement-fine aggregate grout to produce a smooth, polished surface.

While the lightweight pipes of this invention have relatively high strength and resist breakage, they can be further strengthened by incorporation of reinforcing materials during the molding or casting operation. Thus, such materials as metal wires, metal mesh, glass fibers and the like may be distributed within the shank or bowl or both to provide additional resistance to breakage. Where desirable, tapped metal inserts adaptable to receive the pipe stem and having metal reinforcing rods integral therewith may be fitted to the mold and the pipe forming mixture poured therein so as to fix the metal insert firmly in the formed shank. Generally, the use of reinforced materials is not necessary, since the coating and the pipe will themselves be strong.

EXAMPLES

In order to illustrate this invention, a lightweight concrete mixture was prepared by admixing 1 part water, 1 part Portland cement (Type I) and 6 parts pumice (all parts by volume), and this mixture was employed in casting a pipe bowl with attached shank. The mixture was agitated by means of an electric vibrator during the mold-filling period. The mold itself was formed of a polyacrylonitrile thermoplastic which provided a smooth, lustrous finish to the cast piece. Also, vinyl, plaster (preferred), or metal molds can be used.

The molded pipe was allowed to age for one or more days, steam cured for 12-24 hours, then baked to dry. The resulting pipe was found to provide an extremely cool smoke of uniquely sweet taste. The bowl remained cool and comfortable, and the smoke had a pleasant taste even after considerable usage. The pipe was extremely lightweight and comfortable when held between the teeth.

A number of concrete mixtures containing ratios by volume of 1 part Portland cement, 1 part water and varying amounts of well graded aggregate were similarly prepared. Substantially similar results were obtained with aggregate in quantities of 2 to 10 parts by volume per part cement. Use of more than 8 parts of aggregate per part water resulted in a pipe of somewhat inferior strength. Thus, while higher percentages of aggregate are useful in giving lighter weight pipes, the disadvantage of lower strength may outweigh this advantage.

The quality of a pipe—the taste and smell of the tobacco burned in it—is highly dependent on the size and density of pores in the material from which the pipe is made. For Portland cement of the porosity mentioned herein, and the aggregates used with it in the present invention, these pore sizes are quite small, typically in the range of 5 Angstroms and up. Additionally, all of the materials used in the present pipes have pore structures which are very similar. This compatibility permits casting of pipes in any desired shape or size in an extremely inexpensive process. Also, because these materials are well characterized, casting will permit a high degree of uniformity, in contrast with the extremely variable nature of natural pipe materials such as briar or meerschaum.

While a specific form of the improvement has been described and illustrated herein, it should be understood that the same may be varied within the scope of the appended claims without departing from the spirit of the invention.

I claim:

1. An article of manufacture being a smoking pipe having a bowl for holding tobacco, said bowl being comprised of a lightweight concrete hardened from a mixture of Portland cement and water and at least one aggregate material selected from the group consisting essentially of perlite, pumice, molecular sieve materials, and mixed oxides of calcium, silicon and aluminum, where the ratio of said aggregate to said Portland cement is in the range of about 3/1 to about 8/1 by volume, said concrete having a density in the range of about 40-80 lbs./ft.$^3$, where the pore size of the hardened water and Portland cement mixture is substantially the same as the pore size of said aggregate.

2. The pipe of claim 1, where said pore size of said hardened concrete is in the range of 5 Angstroms and up.

3. The pipe of claim 2, where the bulk density of said aggregate is in the range of about 10–50 lbs./ft.$^3$.

4. The pipe of claim 1, where said concrete includes said aggregate and Portland cement, said cement being mixed with water, the ratio being one part cement to 0.8–1.2 parts by volume water.

5. A smoking pipe having a bowl for holding tobacco, said bowl being comprised of a concrete hardened from a mixture including one part Portland cement, 1.0–1.4 parts water, and 3–8 parts porous aggregate, said proportion being by volume, where said porous aggregate includes at least one of the group consisting essentially of perlite, pumice, vermiculite, molecular sieve materials, and mixed oxides of calcium, silicon, and alumium, where the pore size of said hardened concrete mixture is in the range of about 5 Angstroms and up.

6. The pipe of claim 5, further including a plastic coating on said concrete bowl.

7. A smoking pipe comprised of a pipe bowl for holding tobacco and a shank portion, said pipe bowl and shank being comprised of a concrete mixture including a porous aggregate having a pore size in the range of about 5 Angstroms and up and Portland cement mixed with a sufficient amount of water to produce a hardened cement having a pore size substantially the same as the pore size of said porous aggregate.

8. The pipe of claim 7, where said pipe bowl is a cast concrete mixture.

9. The pipe of claim 7, where said concrete mixture has a density in the range of about 10–50 lbs./ft.$^3$.

10. The pipe of claim 7, where said porous aggregate and said cement are mixed in a propagation aggregate/cement of about 3/1–8/1, by volume.

11. A method for making a smoking pipe bowl, including the steps of mixing Portland cement with water in the ratio cement/water of one part cement to 0.8–1.4 parts water, by volume, and a porous aggregate to produce a porous concrete, the ratio of aggregate to said Portland cement being in the range of about 3/1 to about 8/1 by volume, the amount of water being chosen to yield a concrete having essentially the same porosity as said aggregate where the pores in said concrete are substantially interconnected to each other to provide a concrete having long range porosity essentially throughout its thickness, and casting said mixture of Portland cement, water and porous aggregate into a desired shape and hardening said mixture to produce said pipe bowl.

12. An article of manufacture being a smoking pipe having a bowl for holding tobacco, said bowl being comprised of a lightweight concrete which is hardened from a mixture including Portland cement and water and at least one aggregate material selected from the group consisting of perlite and pumice, where the ratio of Portland cement to water is in the range of one part cement to about 0.8–1.4 parts water, by volume, and the ratio of said aggregate to said Portland cement is in the range of about 3/1 to about 8/1 by volume and wherein said lightweight concrete has pores therein with sizes in the range of 5 Angstroms and up.

13. An article of manufacture, being a smoking pipe having a bowl for holding tobacco, said bowl being comprised of a lightweight concrete which is hardened from a mixture including Portland cement and water and at least one aggregate material selected from the group consisting of perlite and pumice, where said perlite and pumice have pore sizes in the range of about 5 Angstroms and up, and said cement-water mixture is sufficiently watery to leave pores therein when said mixture is hardened, said cement pores being in the range of about 5 Angstroms and up.

14. An article of manufacture, being a smoking pipe having a bowl for holding tobacco, said bowl being comprised of a lightweight concrete which is hardened from a watery mixture including Portland cement and water and at least one aggregate material selected from the group consisting of perlite and pumice, where said perlite and pumice having pore sizes in the range of about 5 Angstroms and up, and wherein the ratio of said aggregate to said Portland cement is in the range of about 3/1 to about 8/1 by volume.

15. A method for making a smoking pipe bowl, including the steps of:

mixing Portland cement with water in the ratio cement/water of one part cement of 0.8–1.4 parts water, by volume, and a porous aggregate to produce a porous concrete, the ratio of aggregate to said Portland cement being in the range of about 3/1 to about 8/1 by volume, to provide a concrete having pores therein with pore sizes in the range of 5 Angstroms and up, and casting said mixture of Portland cement, water and porous aggregate into a desired shape and hardening said mixture to produce said pipe bowl.

* * * * *